United States Patent [19]

Mendelson

[11] 4,441,069

[45] Apr. 3, 1984

[54] SELF-EXTINGUISHING LOAD DRIVING SYSTEM

[75] Inventor: Robert M. Mendelson, Murray Hill, N.J.

[73] Assignee: RCA Corporation, New York, N.Y.

[21] Appl. No.: 334,818

[22] Filed: Dec. 28, 1981

[51] Int. Cl.[3] ..... G05F 5/00

[52] U.S. Cl. ..... 323/239; 219/494; 219/501; 219/508; 307/252 B; 323/245

[58] Field of Search ..... 323/245, 271, 323, 324, 323/239; 219/494, 501, 507, 508; 307/252 B, 252 Q

[56] References Cited

U.S. PATENT DOCUMENTS

| | | | |
|---|---|---|---|
| 4,129,791 | 12/1978 | Sato | 307/252 Q |
| 4,198,562 | 4/1980 | Mills et al. | 323/271 |
| 4,268,779 | 5/1981 | Eichelberger et al. | 307/252 Q |
| 4,315,141 | 2/1982 | Mills et al. | 219/508 |
| 4,357,524 | 11/1982 | Apfelbeck | 219/501 |

FOREIGN PATENT DOCUMENTS

| | | | |
|---|---|---|---|
| 2334409 | 1/1975 | Fed. Rep. of Germany | 219/501 |

OTHER PUBLICATIONS

Application Note AN-6936, Entitled Thyristors, Published by RCA, Jan. 1981.

*Primary Examiner*—William H. Beha, Jr.

*Attorney, Agent, or Firm*—Joseph S. Tripoli; George E. Haas; Henry I. Schanzer

[57] ABSTRACT

A load and the main conductions paths of first and second TRIACs are connected in series between first and second power terminals across which an alternating voltage is applied. The first TRIAC is for controlling the power dissipated in the load and the second TRIAC is for unconditionally removing power to the load a predetermined time after the first and second TRIACs are turned-on. The first and second TRIACs are interconnected so that the main terminal 1 (MT1) of one is connected to the main terminal 1 (MT1) of the other at a common point. A control circuit for turning-on and turning-off each TRIAC is connected between the gate electrode of each TRIAC and the common point.

7 Claims, 4 Drawing Figures

SELF-EXTINGUISHING LOAD DRIVING SYSTEM

This invention relates to circuitry for controlling the application of power to a load.

In the accompanying drawing like reference characters denote like components, and FIG. 1 is a diagram illustrating a problem associated with controlling the turn-on and turn-off of two TRIACs connected in series;

In many applications it is desirable to apply power to a load for a predetermined period of time and to be able to control the power through the load during the period. At the end of the period it is desirable that no power be dissipated in the load or in the circuitry applying power to, and controlling the power through, the load. This increases the efficiency, safety and reliability of the system.

By way of example, the heating element (i.e. the load) of an electric blanket may be selectively connected across a 110 v AC line via a first control switch for a maximum predetermined period of, for example, 8 hours. During the 8 hour period the temperature of the blanket may be controlled by means of a second control switch. To prevent the indefinite powering of the blanket due to the forgetfulness or oversight of the user, it is desirable that the first switch be automatically turned-off at the end of the predetermined period and that thereafter no power be dissipated in the circuitry controlling the first and second switches.

Figure 1:
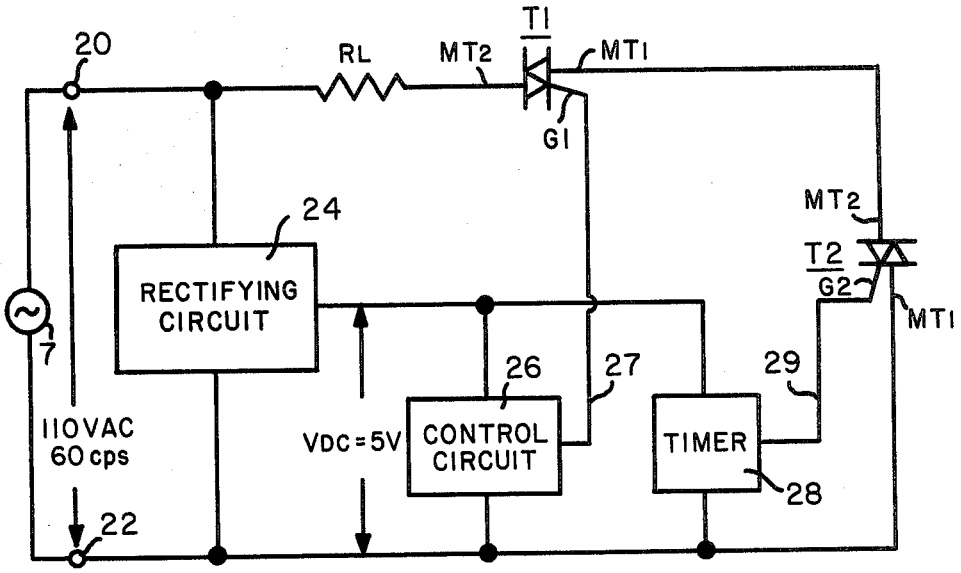

Applicant recognized that to provide a system having a high degree of reliability and safety it is desirable to connect the first and second control switches in series with each other and in series with the load across the AC line. This system is then relatively fail-safe since it requires that both switches be short-circuited due to a failure (a highly improbable event) to have continuous uncontrolled power applied across the load. However, a serious problem exists in the interconnection of the switches in series as best explained with reference to FIG. 1, which was a circuit originally designed and built by the present inventor.

Figure 2:
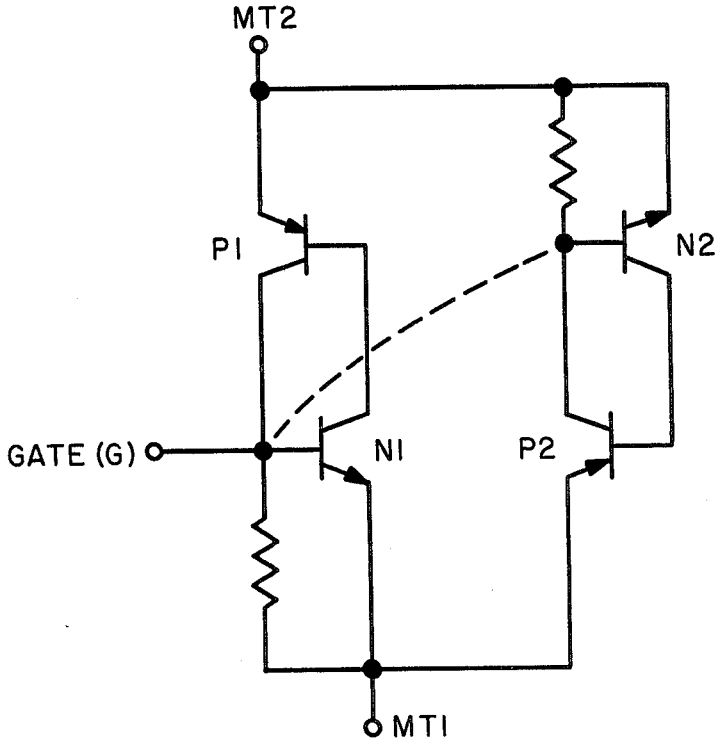
Fig. 2 PRIOR ART
FIG. 2 is a simplified equivalent circuit of a TRIAC.

For ease of understanding the discussion to follow, an overly simplified equivalent circuit of a TRIAC is shown in FIG. 2. For a more accurate and complete description reference is made to an Application Note AN6936 titled TRIAC GATE CHARACTERISTICS AND DRIVE CONSIDERATIONS published by RCA Corporation, January 1981. A TRIAC has a gate electrode (G), a first main terminal 1 (MT1), and a second main terminal 2 (MT2). The TRIAC can conduct current bidirectionally (i.e. from MT1 to MT2 or from MT2 to MT1). However, control of the turn-on is between the gate electrode and MT1. The TRIAC may be viewed (when it conducts bidirectionally) as two regeneratively connected switches (i.e. P1, N1 and P2, N2) connected in parallel. Whenever the gate potential is more positive (or more negative) than MT1 by a certain threshold level (e.g. 1.0 volt or more) the TRIAC is fired and can conduct in either direction. Once the TRIAC is on, the gate loses control and the TRIAC continues conducting so long as the potential across MT1-MT2 exceeds a given threshold level. When the potential ($V_G$-to-$M_{T1}$) between the gate and MT1 is held below the threshold level, the TRIAC turns-off when the potential across MT1-MT2 decreases to zero and remains turned-off thereafter. Various TRIACs and their properties are described at pages 457–512 in publication titled POWER DEVICES published by RCA Corporation, copyright 1978.

Referring back to FIG. 1, a source 7 of alternating current (AC) of 110 volts at 60 cps is connected between power terminals 20 and 22. A load RL is connected between terminal 20 and the main terminal 2 (MT2) of a TRIAC T1 and a TRIAC T2 is connected at its main terminal 2 (MT2) to the main terminal 1 (MT1) of T1 and at its main terminal 1 (MT1) to power terminal 22. A rectifying circuit 24 connected between terminals 20 and 22 generates a 5 volt DC level with respect to terminal 22 which is used to power a control circuit 26 and a timer circuit 28. An output 27 of circuit 26 is connected to the gate (G1) of TRIAC T1 and an output 29 of timer 28 is connected to the gate G2 of TRIAC T2.

A problem occurs, for example, when, following the turn-on of T1 and T2 and the conduction of current through RL, T1 and T2, T2 is subsequently turned-off. The flow of current through RL and through the main conduction paths of T1 and T2 is then interrupted. Electrode MT1 of T1 is no longer connected via a relatively low impedance path to terminal 22. Assuming operation during the portion of the AC cycle when terminal 20 is going positive with respect to terminal 22, the potential at gate G1 of T1 rises, following the potential at terminal 20. The potential at G1, which is applied to the output 27 of control circuit 26, rises toward 110 volts AC with respect to the potential at terminal 22.

The application of the high amplitude AC signal on G1 will normally cause the destruction of the control circuit 26 typically designed to operate at a direct current (DC) voltage between 0–10 volts. This may in turn cause the destruction of TRIAC T1 if control ciruit 26 shorts out (because of the excessive voltage between the main terminals MT1-MT2 of T1) causing the gate G1 to be coupled via a short circuit to terminal 22.

Applicant recognized that the problem exists because the gate of each TRIAC is not referenced to its own MT1. That is, the gate (e.g. G1) of one of the TRIACs (e.g. T1) is coupled back to its MT1 via the MT1-MT2 path of the other TRIAC (e.g. T2) and when the other TRIAC is turned-off, there is no low impedance conduction path between the gate and MT1 of the one TRIAC. Accordingly, the potential on the gate of the one TRIAC then rises to or follows the potential at either one of its two main terminals.

The problem discussed above is obviated in circuits embodying the invention by connecting the MT1 electrode of one TRIAC and the MT1 electrode of the other TRIAC to a common point while still connecting their MT1-MT2 paths in series with each other and with the load (RL) between the two power terminals.

Figure 3:
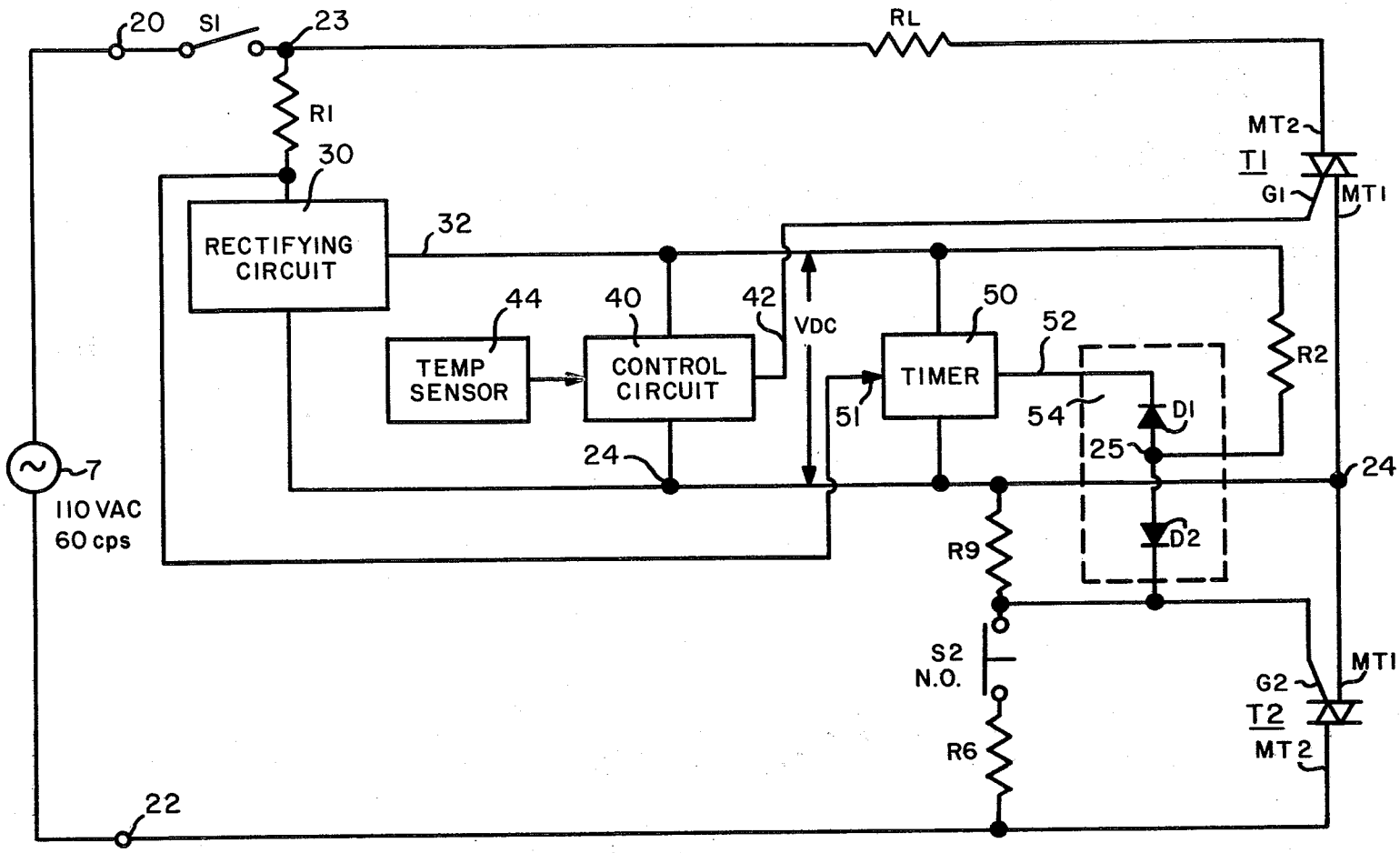
FIG. 3 is a block diagram of a circuit embodying the invention.

The circuit of FIG. 3 includes an AC source 7 supplying 110 volts AC at 60 Hz between power terminals 20 and 22. An on-off switch S1 is connected between terminals 20 and 23, terminal 23 being connected to one end of a resistor RL. RL may be the heating element of an electric blanket but could be any type of load. Electrode MT2 of a TRIAC T1 is connected to the other end of RL and its electrode MT1 is connected to a node 24. The main conduction path of TRIAC T2 is connected between node 24 ad terminal 22 with MT1 of T2 being connected to node 24 and MT2 of T2 being connected to terminal 22. A DC supply circuit 30 which includes rectifying and filtering circuitry to produce a direct current (DC) voltage in response to an AC signal is connected via voltage dropping resistor R1 between terminals 23 and 24. Supply 30 produces a DC voltage at output terminal 32 which has an amplitude of approximately 5 volts with respect to the voltage at terminal 24.

The DC voltage developed between terminals 32 and 24 functions as the operating potential for a control circuit 40 and a timer 50. Terminal 34 thus functions as the common reference point for the control and timing circuits which determine the turn-on and turn-off of TRIACs T1 and T2.

Control circuit 40 has an output 42 conneted to the gate G1 of TRIAC T1. Control circuit 40 may be any one of a number of known sensor responsive circuits capable of supplying a control signal to the gate of a TRIAC or a like device. A temperature sensor 44 which is used to set and sense the power dissipated (and hence the temperature) in RL has an output coupled to an input of circuit 40. In response to signals from sensor 44 the control circuit 40 generates signals at output 42 which are applied to gate G1 of T1. By way of example, whenever the output at 42 is approximately 1.0 volt above the voltage at node 24, TRIAC T1 turns-on. When the potential at 42 is less than 1.0 volt above $V_{24}$, TRIAC T1 turns-off.

Timer 50 includes binary counting circuitry which divides down the frequency (e.g. 60 Hz) of the AC power signal applied to its "oscillator input" 51. Timer 50 has an output 52 which is coupled via a coupling circuit 54 to the gate G2 of TRIAC T2. Timer 50 can be set to a predetermined count (e.g. 8 hours) and to have a "high" or positive voltage level (e.g. between 1.5 and 5 volts with respect to the voltage at node 24) for the duration of the predetermined count. At the termination of the count, the time output 52 returns to, or close to, zero volt with respect to the voltage at node 24. When the Timer output is "high", a voltage of 1 volt or more is applied between the gate and MT1 of T2, and T2 is then turned-on. When the Timer output is "low", a voltage of less than 1 volt is applied between the gate and MT1 of T2, and T2 turns-off.

A normal open (N.O.) momentary switch S2 is connected via a resistor R6 between terminal 22 and G2 of T2. When S2 is activated (depressed) it turns-on T2.

The operation of the system of FIG. 5 will now be discussed. When the main switch S1 is initially open and then closed with TRIACs T1 and T2 turned-off and with S2 off, none of the circuits 30, 40 or 50 are enabled. Only leakage currents flows through RL, T1 and T2.

When, following the closure of S1, S2 is closed G2 of T2 is enabled turning-on (firing) TRIAC T2. As soon as T2 turns-on, supply 30 is connected across the AC line (terminals 20 and 22) and produces a DC voltage ($V_{32}$) on line 32 which is positive with respect to the voltage ($V_{24}$) at node 24. $V_{32}$ is applied via resistor R2 and a diode D2 to G2 maintaining T2 on. S2, a normally open (N.O.) momentary switch, remains activated long enough (e.g. a few milliseconds) to allow the voltage $V_{32}$ to build up to its full DC value and to latch T2 on. With the positive voltage $V_{32}$ applied to its gate, T2 remains ON after S2 is released and conducts for both the positive and negative cycles of the AC line voltage.

Control circuit 40 and timer 50 are powered by the DC voltage developed between terminals 32 and 24. Terminal 24 functions as a common point to which all AC and DC voltages are referenced. Control circuit 40 provides control signals to gate G1 of T1 in response to the outputs from temperature sensor 44. For example, temperature sensor 44 causes control circuit 40 to produce turn-on pulses when the temperature of the load is below a certain level. When the temperature is at or above a certain level no turn-on pulses are produced at output 42. Thus, the voltage at output 42 control the turn-on and turn-off of T1 thereby controlling the current through load RL and maintaining its temperature at a desired level. Temperature sensor 44 may be placed close to RL and may incude a thermistor whose resistance changes rapidly with temperature so as to control the turn-on and turn-off of T1. When the voltage ($V_{42}$) at node 42 is at, or close to, the potential at node 24 there is zero volt between G1 and MT1 of T1 and T1 turns-off when the AC potential between MT1 and MT2 of T1 goes to zero. G1 and MT1 of T1 are both referenced to node 24 and therefore no large potential is developed between G1 and MT1, whereby T1 can be easily and safely turned-off. The turn-off of T1 blocks the flow of current (and hence power dissipation) through RL for the duration of the time T1 is turned-off. However, supply 30 and circuits 40 and 50 remain powered via conduction through T2. Since T2 is on, G1 and MT1 of T1 are coupled via the main conduction path of T2 to terminal 22. As above, T1 can be, subsequently, selectively turned-on to power the load and can be, subsequently, selectively turned-off without affecting the DC supply, timing or control circuitry.

Timer 50 powered by the DC supply 30 has a sample of the 60 Hz line voltage applied to its oscillator input 51. The timer output 52 will be high (between 1.5 and 5.0 volts) while the timer counts down or divides the input oscillator frequency. Assume, for example, that the timer is set to count 8 hours. Output 52 will be high for 8 hours from the time (after S1 and S2 are turned-on) that T2 is turned-on.

At the end of the set period, the output 52 goes "low" (i.e. node 52 is coupled via the timer to node 24) whereby the potential between output 52 and terminal 34 is at, or close to, zero volt. With the voltage at the cathode of D1 "low", node 25 at the anodes of D1 and D2, is at approximately one $V_F$ drop above $V_{24}$; where $V_F$ is the forward voltage drop of the diodes. Consider, for purpose of this discussion that $V_{52}=V_{24}=0$, and diode D1 conducts so its anode is $V_F$ volts (e.g. 0.8 volt) above 0. The potential at the gate of G2 is then at or close to the potential at node 24 and TRIAC T2 turns-off (when the AC potential) across MT1-MT2 decreases to zero) since G2 and MT1 of T2 are at or very close to the same potential. Since G2 and MT1 of T2 are both referenced to node 24, no large differential will develop between these two electrodes and T2 can be safely and effectively turned-off.

When T2 turns-off, the conduction path between terminal 24 and one end of the AC line (terminal 22) is opened, and the conduction path via the circuit between terminals 20 and 22 is then interrupted. The DC potential produced by rectifier circuit 30 collapses, timer 50 stops counting, and control circuit 40 produces no further signal to the gate of T1 which also turns-off. Since G1 and MT1 of T1 are referenced to node 24 there is no large potential differential developed between these electrodes and the system shuts down without problem.

The only current in the system is the leakage current flowing through the two turned-off TRIACs whose conduction paths are connected in series. Thus, even where the user forgets to turn-off (open) switch S1 the system turns-off at the end of the period to which the timer was set. Obviously, whenever S1 is opened, the system turns-off completely.

Figure 4:
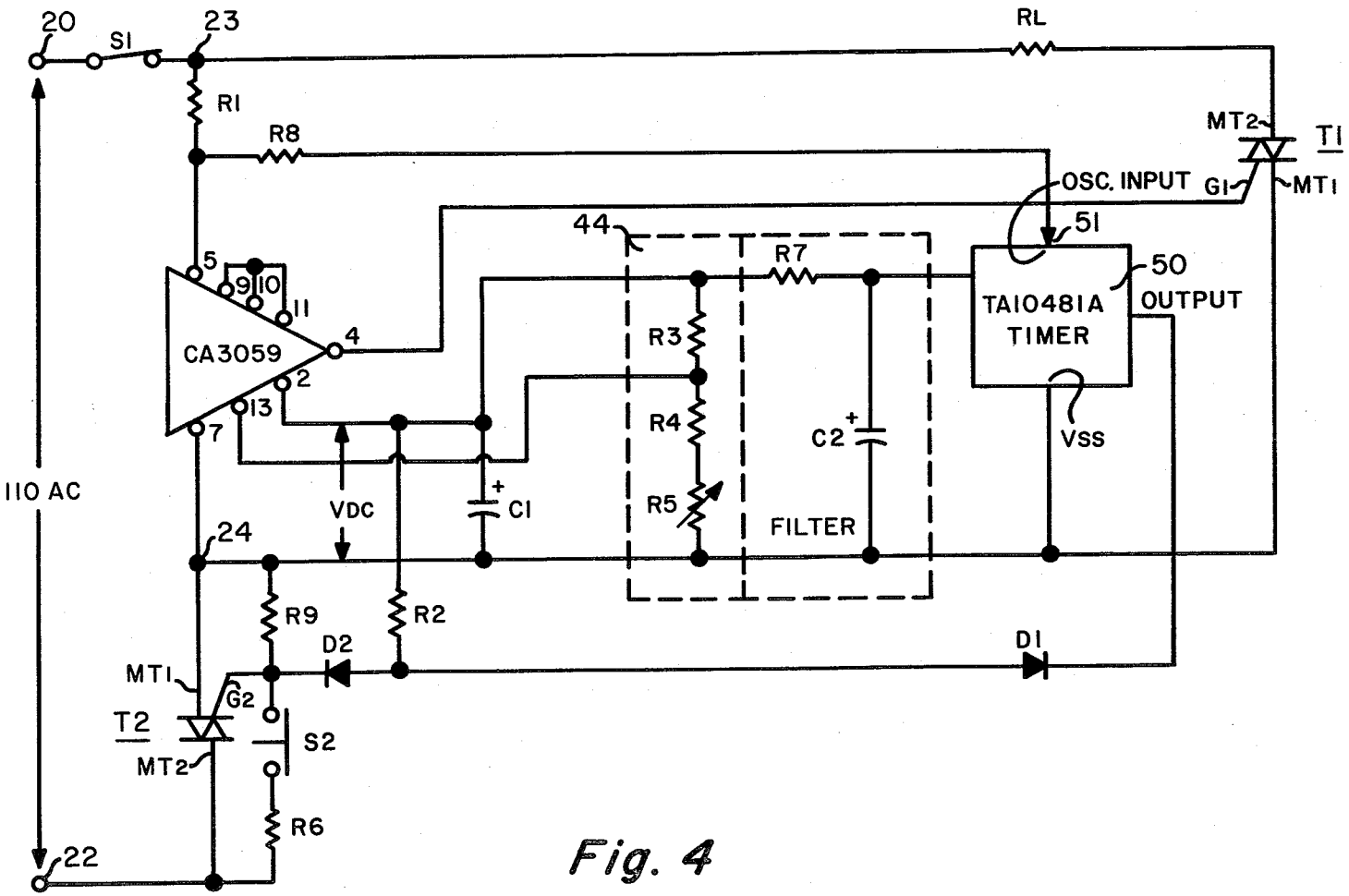
FIG. 4 is a detailed diagram of a circuit embodying the invention.

FIG. 4 illustrates actual components used in an embodiment of the invention that was constructed. The functions of the DC supply 30 and control circuit 40 of FIG. 3 are provided by a zero voltage switch integrated circuit known as the CA3059 manufactured by RCA Corporation. The filtering function (within block 30 of FIG. 3) is provided by filter capacitors C1 and C2, and a resistor R7 of FIG. 4. The temperature sensor 44 includes a thermistor R3, a fixed resistor R4, and a variable resistor R5 connected in series between pins 2 and 7. Resistor R3 connected between pins 2 and 13 of the CA3059 and resistor R4 and variable resistor R5 connected in series between pins 13 and 7 control the temperature setting of RL.

Pin 5 of the CA3059 is an AC input terminal which is permanently connected to terminal 23 via dropping resistor R1. Pin 7 of the CA3059 is its "ground" pin which is connected to node 24 which in turn is coupled via MT1-MT2 of T2 to terminal 22. Pin 7 (node 24) may be considered to be a DC pseudo ground to which all AC and DC voltages are referenced. TRIACs T1 and T2 are type T2300 manufactured by RCA Corporation. When the AC line voltage is connected across pins 5 and 7, the CA3059 rectifies the 8 volts AC at pin 5 and provides a voltage of approximately 6 volts DC at pin 2, which is filtered by a capacitor, C1. The DC produced a pin 2 supplies a holding current to the gate G2 of TRIAC T2 through a 2.2K ohm resistor, R2. This keeps T2 on, even when S2 is released.

The CA3059 produces positive-going pulses at its pin 4 in response to inputs from sensor 44 applied to pin 13 of the CA3059. The output pulses from pin 4 are used to turn-on and to turn-off T1 thereby controlling the current through the load. R3, may be a thermistor placed close to RL whose resistance changes rapidly with temperature so as to sense when to turn-off T1. Timer 50 may be a TA10481A which is a complementary metal oxide semiconductor (CMOS) timekeeping device manufactured by RCA Corporation. The operating potential for the timer is obtained through dropping resistor R7 from pin 2 of the CA3059. A capacitor C2 further filters the voltage applied to the timer. A sample of the 60 Hz line voltage is taken from pin 5 of the CA3059 by a dropping resistor (current limiting) R8, and applied to the "oscillator input" of the timer 50. The timer, by successive divisions produces a signal at its output pin which is "high" during a set period and which goes "low" at the end of the set period. At the end of the set period (e.g. 8 hours) the output pin of the timer goes low (ground) and pulls the gate of T2 close to ground turning-off T2.

The circuit embodying the invention thus includes a self-extinguishing feature whereby the system draws only TRIAC leakage currents when the systems turns-itself-off. Also, the circuit includes the fail-safe feature requiring both TRIACs to be on for current to flow through the load. Both TRIACs have to fail for uncontrolled current to flow through the load after the set period.

What is claimed is:

1. The combination comprising:

first and second power terminals for the application therebetween of an AC operating voltage;

first and second control switches, each one of said control switches having a control gate, and first and second main electrodes defining the ends of the main conduction path of the control switch, and each one of said first and second control switches capable of conducting current in either direction along its main conduction path in response to a voltage greater than a given threshold applied between its gate and its first main electrode, each one of said first and second control switches being of the type which can be turned-on only by a turn-on signal applied between its control gate and its first main electrode;

a load;

means connecting the first main electrode of said first control switch and the first main electrode of said second control switch to a common node;

means connecting the main conduction paths of said first and second switches and said load in series between said first and second power terminals;

a first control means coupled between said control gate of said first control switch and said common node for controlling the turn-on and turn-off of said first control switch; and a second control means independent from, and different than, said first means coupled between said control gate of said second control switch and said common node for controlling the conductivity of said second control switch independently of the turn-on and turn-off of said first control switch.

2. The combination as claimed in claim 1 wherein said first and second control switches are TRIACS.

3. The combination as claimed in claim 1 wherein said first control means controls the turn-on and turn-off of said first control switch as a function of the power dissipated in said load;

wherein said second control means is a timer selectively set to a predetermined time period for turning off said second control swtich at the end of said predetermined period.

4. The combination as claimed in claim 2 wherein said first and second control means are coupled between one of said first and second power terminals and said common node;

wherein an operating potential is developed and applied to said first and second control means when at least one of said first and second control switches is turned-on;

and wherein there is no operating potential applied to said first and second control means when said first and second control switches are turned off.

5. The combination as claimed in claim 1 wherein said first and second control means are coupled between one of said first and second power terminals and said common node whereby said control means are in parallel with the main conduction path of one of said first and second control switch means and wherein the conduction path of the other one of said first and second control switch means provides a conduction path between said control means and said other one of said first and second power terminals whereby no power is dissipated in said first and second control means when said first and second control switches are turned off.

6. The combination comprising:

first and second power terminals for the application therebetween of an AC operating voltage;

first and second control switches, each one of said control switches having a control gate, and first and second main electrodes defining the ends of the main conduction path of the control switch, and each one of said first and second control switches capable of conducting current in either direction along its main conduction path in response to a voltage greater than a given threshold applied between its gate and its first main electrode;

a load;

means connecting the first main electrode of said first control switch and the first main electrode of said second control switch to a common node;

means connecting the main conduction paths of said first and second switches and said load in series between said first and second power terminals;

a first control means coupled between said control gate of said first control switch and said common node for controlling the turn-on and turn-off of said first control switch as a function of the power dissipation in said load; and a second control means including a timer selectively set to a predetermined period coupled between said control gate of said second control switch and said common node for turning off said second control switch at the end of said predetermined period.

7. The combination as claimed in claim 6 wherein said first and second control switches are TRIACS.

* * * * *

UNITED STATES PATENT AND TRADEMARK OFFICE
CERTIFICATE OF CORRECTION

PATENT NO. : 4,441,069

DATED : April 3, 1984

INVENTOR(S) : Robert M. Mendelson

It is certified that error appears in the above-identified patent and that said Letters Patent is hereby corrected as shown below:

Col. 2, line 68, change "ad" to - - - and - - -.

Col. 3, line 12, change "34" to - - - 24 - - -.

Col. 3, line 16, change "conneted" to - - - connected - - -.

Col. 3, line 39, change "time" to - - - timer - - -.

Col. 3, line 54, insert a comma after the word "closed".

Col. 4, line 43, change "34" to - - - 24 - - -.

Col. 6, line 36, after "load;"insert - - - and - - -.

Col. 6, line 41, change "2" to - - - 1 - - -.

Signed and Sealed this

*Sixteenth* Day of *October 1984*

[SEAL]

*Attest:*

GERALD J. MOSSINGHOFF

*Attesting Officer*

*Commissioner of Patents and Trademarks*